US005114015A

United States Patent [19]

Mussini

[11] Patent Number: 5,114,015

[45] Date of Patent: May 19, 1992

[54] DELIVERY DEVICE AND SORTING MACHINE FOR ROD-LIKE ARTICLES

[75] Inventor: Gian P. Mussini, St. Imier, Switzerland

[73] Assignee: Fabriques de Tabac Reunies, S.A., Neuchatel, Switzerland

[21] Appl. No.: 582,087

[22] Filed: Sep. 14, 1990

[30] Foreign Application Priority Data

Sep. 25, 1989 [GB] United Kingdom ..... 8921629

[51] Int. Cl.[5] ..... B07C 5/18

[52] U.S. Cl. ..... 209/535; 131/907; 177/145; 209/593; 209/924; 209/941; 221/200; 221/266

[58] Field of Search ..... 209/517, 518, 535-537, 209/564, 592-596, 657, 698, 903, 910, 911, 916, 921, 924, 933, 941; 131/907, 908; 177/145; 221/196, 200-202, 223-225, 236, 238, 266

[56] References Cited

U.S. PATENT DOCUMENTS

| | | | |
|---|---|---|---|
| 2,329,975 | 9/1943 | Best | 177/145 |
| 2,483,609 | 10/1949 | Barmore | 221/238 |
| 2,858,046 | 10/1958 | Pollmann | 221/224 X |
| 2,924,356 | 2/1960 | Pollmann et al. | 221/201 X |
| 3,043,507 | 7/1962 | Davis et al. | 177/145 X |
| 3,189,178 | 6/1965 | Calleson et al. | 209/535 |
| 3,258,117 | 6/1966 | Domeck, Jr. et al. | 209/537 |
| 3,305,128 | 2/1967 | Dearsley | 221/201 X |
| 3,365,057 | 1/1968 | Dunlap | 209/595 |
| 3,458,086 | 7/1969 | Strohmeier | 221/225 X |

FOREIGN PATENT DOCUMENTS

| | | | |
|---|---|---|---|
| 0950584 | 2/1964 | United Kingdom | 209/594 |

*Primary Examiner*—Michael S. Huppert
*Assistant Examiner*—Edward M. Wacyra
*Attorney, Agent, or Firm*—Jeffrey H. Ingerman

[57] ABSTRACT

A device for sorting rod-like articles, for example cigarettes, according to their weight. The device feeds a single article from a hopper into a channel with the aid of two ribbed drums. The article then drops into a groove in a delivery shaft where it is tipped onto a series of "V"-shaped members located on the top of a balance. The weight of the article is determined and the article is then ejected by lifting arms onto the top wall of a ramp. The article is allowed to roll freely down the ramp. A microprocessor causes one of a number of doors in the top wall of the ramp to open according to the weight of the aritcle and the article then drops into a compartment below the ramp.

7 Claims, 2 Drawing Sheets

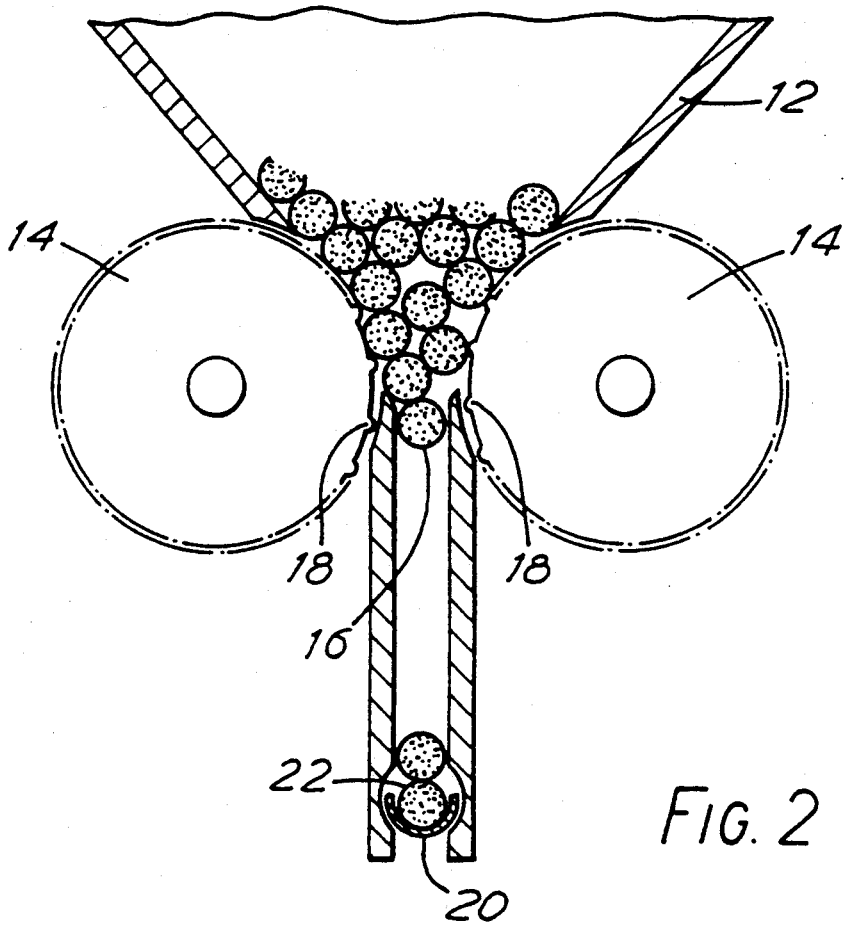
FIG. 2
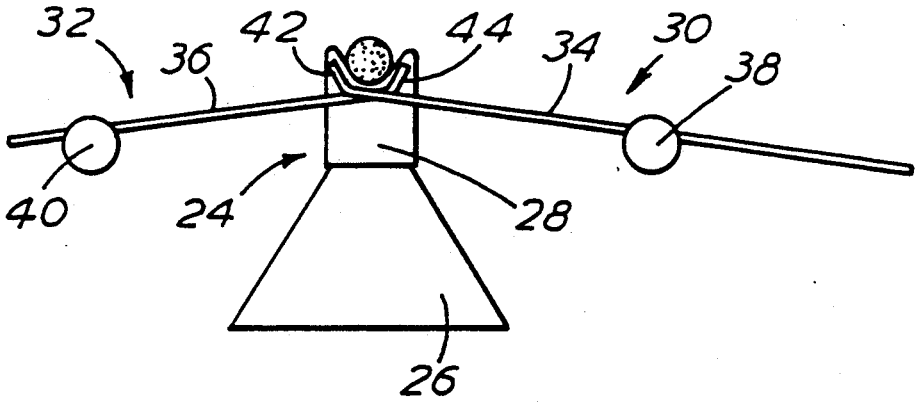

DELIVERY DEVICE AND SORTING MACHINE FOR ROD-LIKE ARTICLES

BACKGROUND OF THE INVENTION

The invention relates to delivery devices and to sorting machines incorporating said devices, which are particularly useful for sorting cigarettes.

It is often desirable to be able to classify rod-like articles accurately by weight, particularly if samples are to be used for laboratory analysis, where very slight differences in weight may be of importance. This is particularly true in the case of cigarettes.

Known cigarette sorting machines are often large and cumbersome, and each is specially adapted to work with a specific weighing apparatus.

SUMMARY OF THE INVENTION

The invention provides a delivery device for rod-like articles comprising: a hopper for the articles having at its bottom two parallel rotatable ribbed drums spaced to form a channel between them, the drums being capable of reciprocating rotary movement to feed the articles singly from the hopper through the channel; a rotatable delivery shaft located beneath and parallel to the channel and longitudinally grooved to accept rod-like articles, the shaft moving between a first position in which it accepts an article from the channel and a second position in which it ejects the article onto an elongate support shaped to receive a rod-like article; and a set of lifting arms on one side of the longitudinal axis of the support which extend through the support, the movement of the arms being in timed relationship with the movement of the delivery shaft so that the arms are lifted after the article has been delivered onto the support, enabling the article to be lifted clear of the support and delivered to collecting means.

BRIEF DESCRIPTION OF THE DRAWINGS

The invention will further be described by way of example with reference to the drawings in which:

FIG. 2 shows a vertical section through a detail of the embodiment of FIG. 1.

Figure 1:
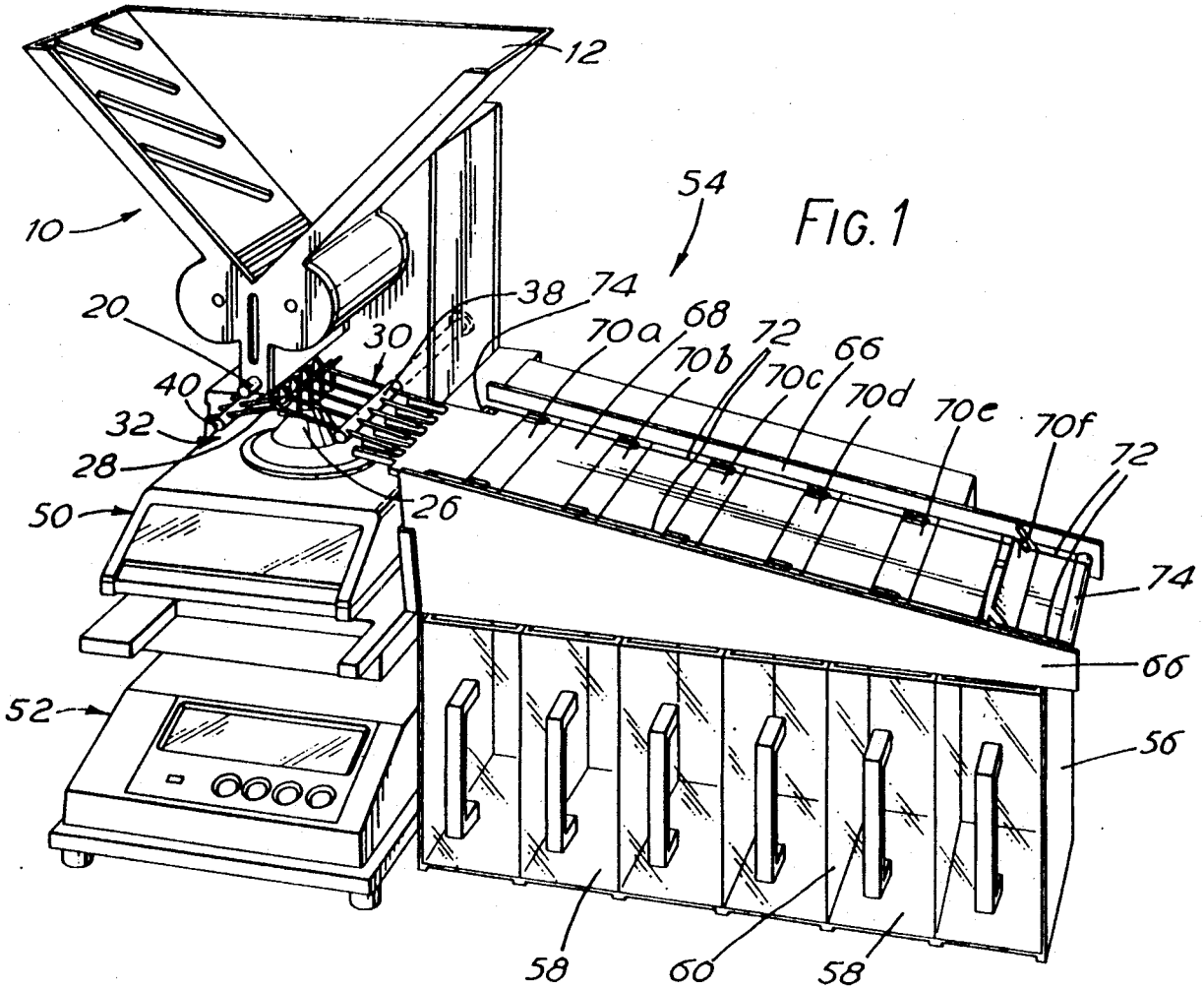
FIG. 1 shows a view of one embodiment of the invention.

A cigarette delivery device 10 according to one embodiment of the invention has a hopper 12, supported above two parallel ribbed, cylindrical drums 14 which are capable of rotation about their longitudinal axes. A channel 16 is formed between the drums of suitable dimensions for the passage of a cigarette, the longitudinal axis of the cigarette being parallel to the longitudinal axes of the drums. The hopper 12 has no front wall, to facilitate the loading of cigarettes into the hopper.

Each ribbed drum 14 oscillates back and forth through a limited angle, the two drums performing a rotary reciprocating motion. The drums rotate with the same angular speed but in opposite senses. Cigarettes are urged from the hopper 12 into the mouth of the channel 16, which is between the drums 14, by the ribs 18 on the surfaces of the drums.

At the lower end of the channel 16 is supported a generally cylindrical delivery shaft 20 with a groove 22 in it shaped to receive a cigarette. The longitudinal axis of the delivery shaft is parallel to the longitudinal axes of the ribbed drums 14. The delivery shaft 20 is able to rotate about its principal axis. Like the drums 14, it does not perform complete rotations in one direction, but oscillates through an angle.

The oscillation of the delivery shaft 20 is in timed relationship with that of the drums 14, so that when a cigarette is allowed to drop past a pair of ribs 18 of the drums, it falls into the groove 22 of the delivery shaft 20, which is facing upwards towards the channel 16 at that time. The shaft 20 then rotates in one direction until the cigarette is tipped out of the groove 22, and then returns to its original position, ready to receive another cigarette from the channel.

Underneath the delivery shaft 20 is a support 24 for a cigarette. The support 24 has a substantially conical base 26, on top of which is a row of four discrete, V-shaped members 28. The row of V-shaped members serves to form a trough, suitable for holding a cigarette, whose longitudinal axis is aligned with the principal axis of the delivery shaft 20.

A first 30 and second 32 set of lifting arms are positioned on either side of the longitudinal axis of the support 24. Each set 30, 32 comprises a row of spaced parallel arms 34, 36 whose proximal ends are attached perpendicularly to a rotatable rod 38, 40. Each arm 34, 36 also has a bent portion 42, 44 at its distal tip. The longitudinal axis of each rotatable rod is parallel with the longitudinal axis of the support 24.

The arms 34, 36 of each set 30, 32 extend towards one another and are offset so that they interdigitate. Thus the distal ends of each pair of interdigitating arms 34, 36 lie in respective spaces between adjacent V-shaped members 28 of the support 24.

The rotatable rods 38, 40 are capable of partial rotation about their longitudinal axes in opposite directions to one another so that each set of arms may be raised through an angle. Their movement is timed in relation to the movement of the delivery shaft 20, so that after a cigarette is tipped from the shaft 20 and has been delivered to the support 24, the rods 38, 40 rotate. This causes the distal ends of the arms 34, 36 in each set 30, 32 to be raised from between the V-shaped members 28 of the support 24, and so lift the cigarette from the support.

One rotatable rod 38 rotates for longer than the other rod 40 so that the distal ends of the arms 34 of that set 30, are raised higher than the distal ends of the arms 36 of the other set 32. This allows the cigarette, once lifted cleanly from the support 24, to roll down the arms 24 of the first set 30 and into collecting means 54.

The movements of the ribbed drums 14, the delivery shaft 20 and the rotatable rods 38, 40 are all synchronized to ensure efficient working of the machine. This is achieved by having the moving parts of the machine driven from a single motor and suitably geared and cranked in relation to one another.

In a preferred embodiment of a sorting machine according to the invention, as shown in FIG. 1 the device 10 may be used with a scale 50 on which the support 24 rests. When a cigarette lands on the support 24 it is weighted by the scale, and then lifted cleanly off the support by both sets of lifting arms 30, 32. It is desirable to lift the cigarettes cleanly after weighing, to avoid the need for a period between weightings to allow the scale to settle following an unclean lift from the scale.

Also in the embodiment of the invention shown in in FIG. 1, the device 10 is used with a scale 50, a microprocessor 52 and a collecting apparatus 54 adapted to collect analysed samples of cigarettes separately.

The collecting apparatus 54 includes a cuboid box 56 with an open top having six chambers 58 separated by vertical partitions 60. These chambers may conveniently take the form of drawers. A ramp 64 having two triangular side walls 66 and a sloping top wall 68 is supported above the box 56. The side walls 66 extend slightly above the level of the top wall 68. There is a series of doors 70*a, b, c, d, e, f* in the top wall, each of which opens into a respective one of the chambers 58. The ramp is positioned so that it slopes downwardly away from the sorting machine.

Two continuous loops of cord 72 run along the upper surface of the top wall 68 of the ramp, adjacent to each side wall, around cylindrical pulleys 74 at either end of the ramp, and along the lower surface of the top wall 68.

The loops of cord are driven by rotation of one of the pulleys 74 at the upper end of the ramp 64 in one direction, so that the direction of movement of those parts of the cords which lie along the upper surface of the top wall is down the slope of the ramp. The doors 70 have cut outs on their free long edges to allow them to open without fouling the cords 72.

In the operation of the complete embodiment shown, a single cigarette from the hopper 12 is guided into the channel 16 by ribs 18 on the rotating drums 14. The cigarette then falls into the groove 22 of the delivery shaft 20. The delivery shaft rotates and ejects the cigarette onto the support 24. The weight of the cigarette is then determined by the scale 50 which sends a signal to the microprocessor 52. The rotating rods rotate and raise both sets 30, 32 of arms 34, 36, so lifting the cigarette from the support 24. The distal ends of the arms 34 of one set 30 are raised clear of the distal ends of the arms 36 of the other set 32, and the cigarette is then free to roll down the arms of that set 30, and onto the top wall 68 of the ramp. According to the weight of the cigarette, the microprocessor causes one of the doors 70 in the top wall 68 to open, allowing the cigarette to drop into one of the chambers 58 of the box 56. The appropriate door is selected by the microprocessor according to a pre-determined program.

To allow for the length of time spent by the cigarette rolling down the inclined top wall 68, the doors 70 open for different periods of time. Thus, the door 70*a* nearest to the sorting machine opens for the shortest time, while the fifth door 70*e* opens for the longest time. The door 70*f* furthest from the sorting machine is held permanently open.

The moving loop of cord 72 prevents any cigarette which may roll into one of the side walls 66 from becoming lodged against that wall, as the movement of the cord forces the cigarette to continue rolling down the ramp.

According to this embodiment of the invention, cigarettes may be classified by weight and sorted into the various chambers of the collecting box. The microprocessor can be set to define the classes into which cigarettes may be sorted. For example, upper and lower limits may be set for each individual class, or only for a middle class, the processor then determining the limits of the classes on either side. Alternatively, the processor may determine the optimum limits for each class after a preliminary sorting period.

The invention thus provides a relatively small cigarette sorting machine running from a single motor which may be used with several types of test equipment without requiring special calibration. When used with a scale, the sorting machine allows for accurate weight measurement, as the two sets of lifting arms ensure that the cigarette is lifted from its support, and hence the scale, in a single clean movement.

The apparatus can also be used to classify cigarettes other than by weight, the microprocessor being supplied with information from alternative test equipment, such as a laser or a firmness detector, while the cigarette is resting on the support 24.

The delivery device may be used to deliver cigarettes to a test station, such as a smoking machine.

What is claimed is:

1. A delivery device for rod-like articles comprising: a hopper for the articles having at its bottom two parallel rotatable ribbed drums spaced to form a channel between them, the drums being driven for reciprocating rotary movement to feed the articles from the hopper through the channel; a rotatable delivery shaft located beneath and parallel to the channel, and longitudinally grooved to accept rod-like articles, the shaft moving between a first position in which it accepts an article from the channel and a second position in which it ejects the article onto an elongate support shaped to receive a rod-like article; and a first set of lifting arms on one side of the longitudinal axis of the support which extend through the support, and a second set of lifting arms on the opposite side of the longitudinal axis of the support from the first set and interdigitating with the first set, the movement of the arms being in timed relationship with the movement of the delivery shaft so that the arms are lifted after the article has been delivered onto the support, the first set of arms being raised through a greater angle than the second set when in movement, enabling the article to be lifted clear of the support and delivered to collecting means.

2. A delivery device according to claim 1 in which the support comprises a row of substantially V-shaped members.

3. A delivery device according to claim 1 in which the channel is further defined by opposed channel walls spaced apart to receive a single rod-like article, the walls extending between the space between the drums and the delivery shaft.

4. A delivery device according to claim 1 in which the support rests on a scale whereby the rod-like article is weighed when delivered to the support.

5. A delivery device according to claim 1 in which the machine is adapted to receive and deliver cigarettes.

6. A sorting machine comprising a delivery device according to claim 4 and further comprising a microprocessor operably connected to the scale, and a collecting box comprising a plurality of chambers with respective doors opening into the chambers, the doors being operably connected to the microprocessor so that they open to effect sorting of the rod-like articles.

7. A sorting machine according to claim 6 in which the machine is adapted to receive and sort cigarettes.

* * * * *